United States Patent [19]

Thalenfeld

[11] Patent Number: 4,706,917

[45] Date of Patent: Nov. 17, 1987

[54] SHELF HOOK FOR MERCHANDISE AND/OR INFORMATION DISPLAY

[75] Inventor: David R. Thalenfeld, Bear Creek, Pa.

[73] Assignee: Trion Industries, Inc., Wilkes Barre, Pa.

[21] Appl. No.: 888,972

[22] Filed: Jul. 23, 1986

[51] Int. Cl.[4] ..... G09F 3/18

[52] U.S. Cl. ..... 248/205.1; 248/214; 248/222.3; 248/225.2; 248/307; 40/16.4; 24/545

[58] Field of Search ..... 248/213.2, 214, 215, 248/220.2, 225.2, 227, 228, 231.8, 301, 307, 339, 205.1, 222.3; 40/124, 16, 16.2, 16.4, 16.6; 108/97; 52/38; 297/174; 24/530, 545; 211/86

[56] References Cited

U.S. PATENT DOCUMENTS

| | | | |
|---|---|---|---|
| 354,903 | 12/1886 | Hastings | 248/222.3 |
| 739,259 | 9/1903 | Hock | 24/530 |
| 1,027,710 | 5/1912 | Ette | 248/222.3 |
| 1,530,180 | 3/1925 | Holmes | 24/530 |
| 1,558,154 | 10/1925 | Fitch | 40/16 |
| 2,157,020 | 5/1939 | Sanford | 248/231.8 |
| 2,459,909 | 1/1949 | Alofs | 248/214 |
| 2,547,239 | 4/1951 | Walker | 40/16.6 |
| 2,634,928 | 4/1953 | Hawes | 248/214 |
| 2,642,250 | 6/1953 | Kasnowich | 248/214 |
| 2,787,433 | 4/1957 | Slavsky | 40/16.4 |
| 4,526,335 | 7/1985 | Garfinkle | 40/16.4 |

FOREIGN PATENT DOCUMENTS

| | | | |
|---|---|---|---|
| 471831 | 8/1927 | Fed. Rep. of Germany | 248/227 |
| 2356521 | 3/1978 | France | 40/16.6 |

*Primary Examiner*—Ramon S. Britts
*Assistant Examiner*—Robert A. Olson
*Attorney, Agent, or Firm*—Schweitzer & Cornman

[57] ABSTRACT

A two-part display device for mounting on metal shelving panels provided with a rearwardly projecting sheet metal flange. A clip-like mounting member frictionally grips the rearwardly projecting metal flange and forms a vertical socket at the front edge of the shelving. A merchandise hook and/or label device is inserted in the socket and has a portion projecting upward in front of the shelving to positively lock the device onto the shelving. Provision is made for free pivoting movement of a merchandise hook in a side-to-side direction, in case of accidental contact. Key and key slot means is provided to prevent accidental dislodgement. Several different devices may be inserted in a clip-like mounting member of common design.

8 Claims, 10 Drawing Figures

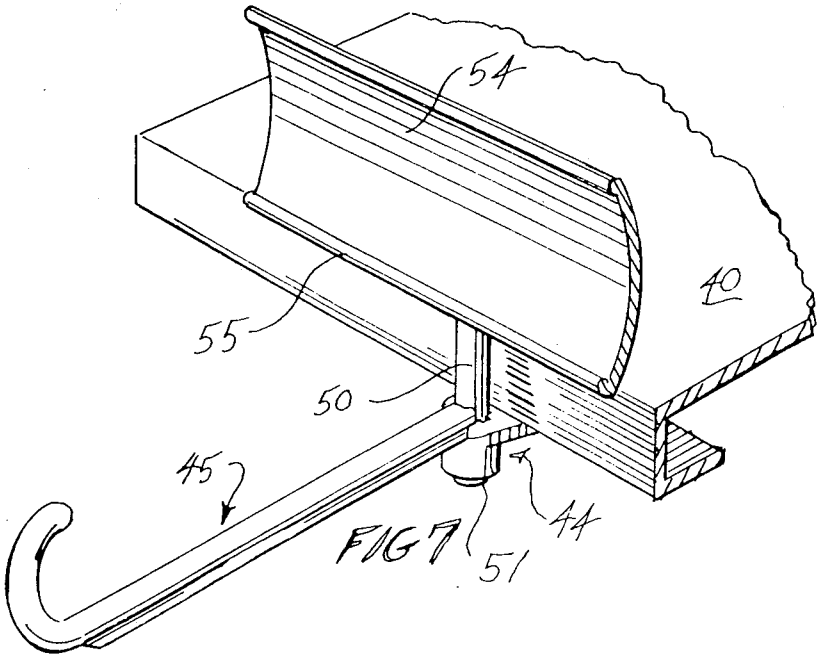
FIG 7
FIG 10
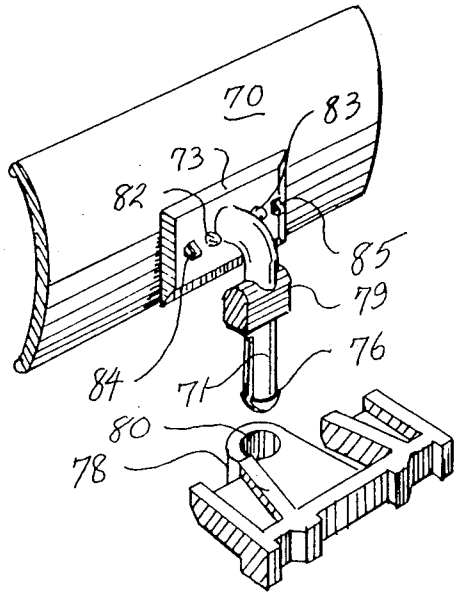
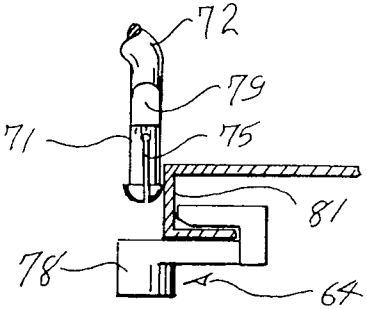
FIG 9

SHELF HOOK FOR MERCHANDISE AND/OR INFORMATION DISPLAY

BACKGROUND AND SUMMARY OF THE INVENTION

The invention relates generally to merchandise display apparatus and more particularly to a novel and improved device for the display of merchandise and/or information at the front of display shelving. The device of the invention is intended especially for use in connection with, although not necessarily limited to, sheet metal shelving having a front configuration in the form of a horizontal "J" formed by the principal flat shelving surface, a downwardly projecting narrow front wall panel and a rearwardly projecting flange.

The new display device advantageously is constructed entirely of plastic and is formed in at least two principal parts, one being a clip-like mounting element for attachment to the rearwardly projecting shelf flange, and the second being a display element for the display of either merchandise or information, and which is mounted by the clip-like device. To particular advantage, the relationship of the clip-like element to the display element is such that, on assembly of the latter to the former, the entire device is locked securely in position on the shelf, so as to prevent its accidental dislodgement.

In one advantageous embodiment of the invention, a merchandise display element, in the form of a rod-like member provided with an upturned outer end, is attached to the clip-like element for pivoting movement about a vertical axis. Accordingly, if the rod-like element is contacted by a shopper passing by the display shelving, neither discomfort to the shopper nor damage to the device is likely to occur, as the device can easily "give" in response to the contact, by pivoting to one side or the other.

In the device of the invention, the clip-like element includes forwardly extending upper gripping arms adapted to overlie the rearwardly projecting flange of the display shelving. A base member of the clip-like device projects forwardly, underneath the shelf flange, and extends slightly forward of the front wall of the shelf, providing a vertical socket located just slightly forward of the front wall. Desirably, the construction of the clip-like device is such that it frictionally grips the flange of the shelving. Nevertheless, in order to positively lock the complete device in position, the display device is arranged to be received in the vertical socket and to project upward therefrom to at least a limited extent, so as to confront the front panel of the shelving. Accordingly, when the display device is inserted in its socket in the clip-like device, the unit is physically interlocked with the display shelving and cannot be removed therefrom without disassembly of the display device.

In a preferred modification of the invention, in which the display element is in the form of a merchandise display hook, the display hook and the clip-like element are provided with a complementary key in the key slot means, such that assembly or disassembly of the hook and the clip-like element may be accomplished only in a predetermined rotational orientation of the display hook. Further, the presence of carded merchandise or the like on the display hook serves to prevent or at least substantially inhibit movement of the hook into that particular rotational orientation, so that disassembly and removal of the display hook is at least very difficult unless it is empty of merchandise.

In the device of the invention, a product information label holder may be utilized with the clip-like mounting element, either alone or in conjunction with a merchandise display hook.

For a more complete understanding of the above and other features and advantages of the invention, reference should be made to the following detailed description of a preferred embodiment of the invention, and to the accompanying drawings.

DESCRIPTION OF THE DRAWINGS

FIG. 7 is a perspective view of the device of FIG. 6.

FIG. 9 is a fragmentary cross sectional view of the device of FIG. 8, with the parts thereof in a partially disassembled relation.

FIG. 10 is an exploded rear perspective view of the device of FIG. 8, showing the parts thereof in a partly diassembled relation.

DESCRIPTION OF PREFERRED EMBODIMENTS OF THE INVENTION

Figures 1, 2, 3, 4, 5, 6, 8:
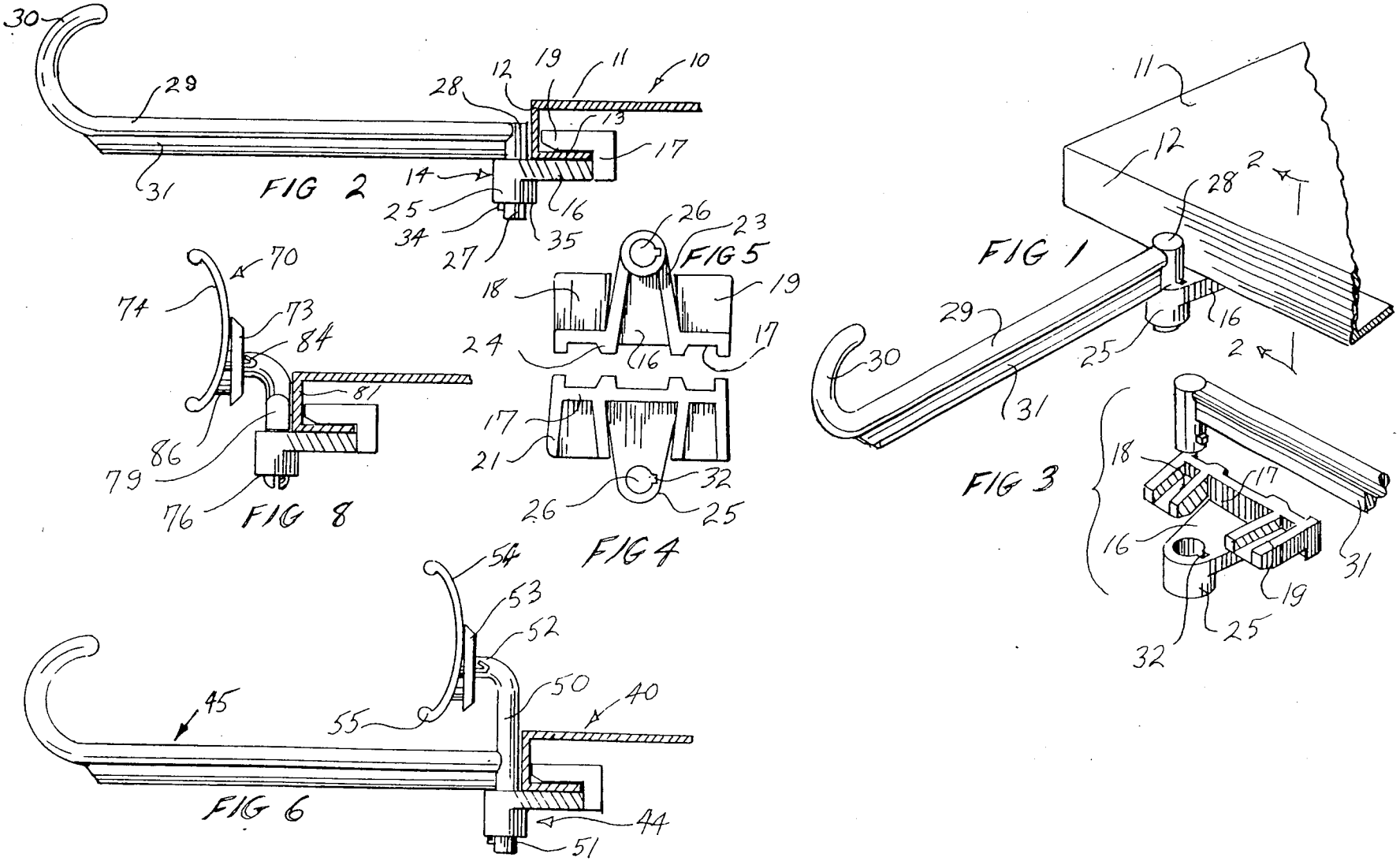
FIG. 1 is a fragmentary perspective view illustrating a section of typical rolled sheet metal shelving having mounted thereon a merchandise display hook device according to the invention.
FIG. 2 is a cross sectional view as taken generally on line 2—2 of FIG. 1.
FIG. 3 is a fragmentary exploded view of the merchandise display device of FIG. 1, with the merchandise hook and mounting clip in a disassembled relation.
FIGS. 4 and 5 are top and bottom plan views respectively of the clip-like element utilized in the merchandise display device of the invention.
FIG. 6 is a cross sectional view, similar to FIG. 2, showing a modified form of the new merchandise display device having an information display label holding feature mounted integrally on a merchandise display hook.
FIG. 8 is a cross sectional view of a modified form of device according to the invention, in which only a label holder element is mounted on the clip-like device.

Referring now to the drawing, and initially to FIGS. 1–5 thereof, the reference numeral 10 designates generally a panel of sheet metal shelving, for which the invention is especially adapted. A shelving panel includes an upper panel section 11, forming the principal shelf surface, an integral, downwardly extending front wall 12, and a rearwardly projecting flange 13. The front wall 12 and rearwardly extending flange 13 typically may be $\frac{3}{8}$th to $\frac{1}{2}$ inch in width, while the upper panel 11 may be of any width appropriate to the purpose.

The merchandising device of the invention is adapted to be clipped onto the front edge area of the shelving 10, to provide for the display of carded merchandise and/or the display of information, such as pricing. In the form of the invention illustrated in FIGS. 1–5 in particular, the invention takes the form of a merchandise display hook, for the display of carded merchandise. The device consists of two principal parts, a mounting clip 14 and a merchandise supporting element 15. Both of these principal parts are, to advantage, formed of molded structural plastic material.

According to the invention, the mounting member 14 is a clip-like device which includes a base member 16 integrally joined along its rear edge to an upwardly extending wall 17. The wall 17 in turn is joined with a pair of spaced, forwardly extending gripping arms 18, 19, which are tapered slightly at their forward ends, as indicated at 20.

In the "normal" configuration of the clip, the gripping arms 18, 19 are spaced from the base member 16 at the rearward extremity of the latter, by a distance sufficient to accommodate the thickness of the rearwardly projecting shelf flange 13. The forwardly projecting portions of the gripping arms, however, converge toward, or perhaps even slightly below, the upper surface of the base arm 16.

In order to apply the clip-like device 14 to the shelf flange 13, the clip is pressed in a forwardly direction over the flange 13. The tapered forward portions 20 of the gripping arms serve to lift the arms over the flange 13 and allow it to slide forward to a position such as shown in FIG. 2. In this position, the gripping arms 18, 19 are displaced from the normal, closely convergent positions, thus causing the shelf flange 13 to be firmly gripped. In this respect, the clip device may be provided with reinforcing flanges 21–24, as necessary, in order to provide the device with desirable strength and frictional gripping characteristics.

At the forward extremity of the base arm 16 is an integral, cylindrical socket member 25, provided with a vertically disposed cylindrical opening 26. To advantage, the cylindrical socket opening is located so as to lie just slightly forward of the shelf front flange 12, when the clip device is mounted on the lower flange 13, as shown in FIG. 2. Received in the socket opening 26 is a vertical pivot shaft 27 forming part of the merchandise display hook 15. The pivot shaft has portions extending vertically above and below the socket 25, with the upwardly extending portion 28 serving to mount a forwardly extending, elongated hook member 29. The hook member 29, although wire-like in shape, is desirably formed of plastic and integrally molded with the pivot shaft 27. The hook 29 is conventionally provided with an upturned outer end 30 in order to retain carded merchandise on the hook against accidental dislodgement. Desirably, the upturned end 30 may be in the form a semi-circle or the like, such that the outermost portion of the hook is gently grounded to avoid any discomfort in case of accidental contact. For at least certain applications, it may be desired to provide a strengthening rib 31 along the bottom of the hook member 15, at least out to a point adjacent the upturned end 30.

Significantly, when the hook member 15 is assembled together with the clip-like mounting member 14, the upwardly projecting portions 28 of the pivot shaft overlie the front of the shelf flange 12. This serves to positively lock the device onto the shelf flange 13, because only extremely limited, if any, rearward movement of the clip-like member is permitted once the hook member 15 is assembled therewith. The device thus becomes self-locking to the shelf in its assembled condition.

An additional advantageous feature of the embodiment of FIGS. 1–5 resides in the provision of a key and key slot arrangement permitting assembly and disassembly of the hook member 15 and clip member 14 only in a predetermined rotational orientation of the hook member. As shown in FIGS. 4 and 5, the socket opening 26 is provided at one side with a key slot 32 which extends vertically through the socket. The pivot shaft 27 is provided at its lower extremity 33 with a small, integral key lug 34 adapted to be received within the key slot 32. As shown in FIG. 3, the relative orientation of the key slot 32 and the key lug 34 is such that, in order to assemble the hook member 15 together with the shelf-mounted clip member 14, the extending portion 29 of the hook needs to be aligned more or less parallel with the front wall 12 of the shelving, in order to allow the key lug 34 to enter and pass through the key slot 32.

As indicated in FIG. 2, the location of the key lug 34 is such that, when the pivot shaft 27 is fully received in the socket 25, the key lug 34 lies just below the bottom surface 35 of the socket. Thus, once the pivot shaft is fully inserted in the socket, the key lug lies wholly below the key slot 32 and is free to be reoriented to any position.

By so relatively orienting the key lug 34 and key slot 32 as to require the hook portion 29 to be nearly parallel with the front of the shelving in order to be assembled or disassembled, accidental dislodgement of the hook member is nearly impossible when there is an item of carded merchandise supported on the hook. In other words, although the hook member 29 may pivot freely relative to the clip member 14, so as to be easily moved in the case of accidental contact, it is very difficult to swing the hook member into its assembly/disassembly orientation with merchandise on it, because the merchandise will engage the front of the shelf and interfere with continued swinging movement of the hook. Accordingly, it will generally prove necessary to remove all of the suspended merchandise before the hook member 15 can be disassembled and removed. This virtually precludes an accidental disassembly or dislodgement when there is any merchandise on the hook.

In the form of the invention shown in FIGS. 6 and 7, the hook member may be provided with a label holder for the mounting of price and other information. In the device of FIGS. 6 and 7, the clip member 44 may be generally of the same construction as the clip member 14 of FIGS. 1–5. For the most part, the hook member 45 may likewise be of the same construction as the hook member of FIGS. 1–5. However, in the modification of FIGS. 6 and 7, the hook member includes an integral, upward extension 50 of the pivot shaft 51, which projects up above the upper surface of the shelf panel 40. The extension 50 is directed forwardly at its upper end 52 and mounts an integral flat plate 53. Mounted on the flat plate 53, preferably removably, is a label holder 54, which is of appropriate size and shape to mount product identification material. Although the particular construction of the label holder 54 and its mounting plate 53 are not significant to the device of the present invention, they are most advantageously of the type shown in my copending application entitled "Merchandise Display Hook with Label Holder" Ser. No. 902,431, certain details of which will be described in connection with the embodiment of FIGS. 8–10.

As reflected in FIG. 6, the upwardly extending label holder support 50 is configured to support the label holder 54 at a height such that its lower extremity 55 is at least slightly above the upper surface of the shelving 40. Accordingly, when the hook member 45 is pivoted substantially to either side of its normal, outwardly projecting position, the extremities of the label holder may swing over the top of the shelving.

In the modification of FIGS. 8–10, a clip-like mounting device 64, of the same general construction as the clip device 14 of FIGS. 1–5, serves to mount a label holder alone, for example to provide price/product information for product being displayed on the shelf itself. The label holder, generally designated by the numeral 70, comprises a vertical shaft 71 provided with an upward extension 72 mounting a flat plate 73. A contoured label holder 74 is secured to the plate 73, in a manner to be described, and is configured conventionally on its front surface to provide means for mounting an information label.

In the illustrated form of the device of FIGS. 8–10, the mounting shaft 71 is provided with a vertical slot 75 throughout most of its length and is provided with a slightly enlarged shoulder 76 near its lower end and an abutment shoulder 77 at its upper end. The label holder device is assembled with the clip-like member 64 by inserting the mounting shaft vertically downward into the socket 78. The slot 75 allows the shaft to compress slightly, to enable the enlarged shoulder 76 to enter and pass through the socket opening. When the shoulder 76 emerges beyond the bottom of the socket, the shaft 71 expands to its normal diameter providing a resilient detent to retain the shaft in assembled position.

The shoulder 77, which limits the downward movement of the mounting shaft 71 into the socket 76, is formed by an integral abutment member 75, which forms a lateral enlargement of the mounting shaft 71.

As shown in FIG. 9, the socket opening 80 is aligned directly forward of the front wall 81 of the shelving, such that, when the label holder 70 is assembled with the mounting clip 64, the abutment 75 lies in directly confronting relation to the front surface of the shelving. Since the abutment extends laterally from the mounting shaft 71 it prevents rotation of the shaft within the socket opening 80 and thus maintains the label holder in a desired alignment with respect to the shelving.

As explained in more detail in my above mentioned related application Ser. No. 902,431, the label mounting plate 73, which itself may be of a standard size and configuration, is adapted to mount label holders 74 of a variety of sizes and configurations. For this purpose, the label mounting plate 73 is provided with a series of four openings, two arranged to closely receive locating pins 82, 83 and two adapted to receive deflectable locking hooks 84, 85. In addition, the label holder 74, is provided with spacing means 86 (FIG. 8) arranged to properly orient the arcuately shaped label holder 74 with respect to the generally flat plate 73. The arrangement is such that the label holder 74 may be simply pressed onto the mounting plate 73. When the deflectable elements 84, 85 pass through openings in the mounting plate and snap back to their original configurations, the label holder is tightly locked in place in a desired orientation relative to the plate. This arrangement provides for a standard mounting member, including the mounting shaft 71, plate 73 etc., to be used for mounting label holders 74 of a wide variety of sizes and shapes to suit a wide variety of customer requirements.

In the modification of FIGS. 8–10, the clip-like mounting device 64 may include a key slot 90, merely for standardization of parts. However, the slot would have no useful function in the arrangement of FIGS. 8–10, where accidental dislodgement of the label holder is neither likely nor a matter of great concern, as compared to accidental dislodgement of a merchandise hook loaded with display merchandise.

In any of the forms of the invention, the device includes a clip-like mounting element, which frictionally clips over the rearwardly projecting lower flange of a panel of metal shelving. A portion of the mounting member projects just slightly forward of the front edge of the shelving and forms a socket for receiving a merchandise display hook and/or a label holding device. Whichever device is mounted in the socket, it serves, when so mounted, to positively lock the assembly in its mounted position on the shelving panel.

In the embodiment of FIGS. 1–5, a merchandise display hook is mounted on the clip-like device in a highly advantageous manner that allows for relatively free side-to-side pivoting of the hook in case of accidental bumping. At the same time, complete dislodgement of the hook from its mounting member is almost impossible, especially if there is any merchandise supported on the hook device.

The particular advantage, a common clip-like mounting member serves to support a variety of display devices, depending upon the particular needs and desires of the customer. The device of the invention thus provides a simple, inexpensive and highly flexible facility for extending the utility of common rolled metal shelving by enabling spot placement of additional hanging display merchandise and/or informative label holders.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A display assembly for mounting on a sheet metal shelf or the like wherein the shelf is of the type having a top panel, a front wall and a rearwardly projecting bottom flange, which comprises, (a) a mounting clip adapted to be mounted on a shelf comprising a body portion adapted to be positioned immediately below the shelf bottom flange and, when so mounted, having front and back end portions extending respectively forwardly of the shelf front wall and rearwardly of the back edge of the shelf bottom flange, (b) said mounting clip including one or more integral, forwardly extending gripping arms adapted, when said clip is mounted on a shelf, to bear frictionally upon the upper surface of the shelf bottom flange, (c) the front portion of said mounting clip comprising a socket disposed vertically and, when the clip is mounted, being located directly in front of the shelf front wall, (d) a separable display device supported by said mounting clip, (e) said display device including a vertical shaft portion received in said socket and having a portion extending upward therefrom and, when said clip is mounted on a shelf, being in close confronting relation to the shelf front wall, whereby to lock the assembled mounting clip and display device in mounted position on a shelf.

2. A display assembly according to claim 1, further characterized by (a) said display device including a merchandise display hook of wire-like configuration integral with and projecting outwardly from said vertical shaft portion, (b) said display hook being pivotable from side-to-side in said socket.

3. A display assembly according to claim 2, further characterized by (a) said socket having a vertical through opening and a key slot extending throughout, (b) said vertical shaft portion having a projecting key lug receivable in said key slot and positioned entirely below said slot when said display device is assembled with said mounting clip.

4. In combination with a sheet metal shelf or the like having a top panel, a front wall and a rearwardly projecting bottom flange, a display assembly which comprises, (a) a mounting clip comprising a body portion adapted to be positioned immediately below said bottom flange and having front and back end portions extending respectively forwardly of said front wall and rearwardly of the back edge of said bottom flange, (b) said mounting clip including one or more integral, forwardly extending gripping arms adapted to bear frictionally upon the upper surface of said bottom flange, the front portion of said mounting clip comprising a socket disposed vertically and located directly in front of said front wall, (d) a separable display device supported by said mounting clip, (e) said separable display device including a portion extending upward above said bottom flange and in close confronting relation to said shelf front wall, whereby to lock the assembled mounting clip and display device in position on said shelf.

5. A display assembly according to claim 1, further characterized by (a) said display device comprising a merchandise display hook, (b) said merchandise display hook including a vertically extending shaft portion received in said socket and extending upward therefrom in confronting relation to said shelf front wall.

6. A display assembly according to claim 5, further characterized by (a) label holder means mounted on said merchandise display hook generally directly above said socket, (b) said label holder means including a shaped member, adapted to receive a label or the like, located above the level of the shelf top panel.

7. A display assembly according to claim 4, further characterized by (a) said display device comprising a label holder having a vertically extending shaft received in said socket, (b) a portion of said shaft, located in close confronting relation to said shelf front wall, having opposed lateral extensions engageable with said front wall to prevent significant rotation of said label holder.

8. A display assembly for use in combination with a sheet metal shelf or the like having a top panel, a front wall and a rearwardly projecting bottom flange, which comprises, (a) a mounting clip comprising a body portion adapted, when mounted on a shelf, to be positioned immediately below the shelf bottom flange and, when so mounted, having front and back end portions extending respectively forwardly of the shelf front wall and rearwardly of the back edge of the shelf bottom flange, (b) said mounting clip including one or more integral, forwardly extending gripping arms adapted, when said clip is mounted on a shelf, to bear frictionally upon the upper surface of the shelf bottom flange, (c) the front portion of said mounting clip comprising a socket disposed vertically and, when said clip is mounted on a shelf, being located directly in front of the shelf front wall, (d) a separable display device supported by said mounting clip, (e) said display device including a member received in said socket and having a portion extending upward therefrom and, when said clip is mounted on a shelf, being in close confronting relation to the shelf front wall, (f) said member serving to lock the assembled mounting clip and display device in mounted position on a shelf.

* * * * *